United States Patent [19]

Poschinger

[11] Patent Number: 4,566,589

[45] Date of Patent: Jan. 28, 1986

[54] GAS CONTAINER

[76] Inventor: Udo Poschinger, Neu Esting, Palsweiser Strasse 3n, D-8037 Olching, Fed. Rep. of Germany

[21] Appl. No.: 584,328

[22] Filed: Feb. 28, 1984

[30] Foreign Application Priority Data

Mar. 4, 1983 [DE] Fed. Rep. of Germany ..... 3307797
Jun. 22, 1983 [DE] Fed. Rep. of Germany ..... 3322328

[51] Int. Cl.[4] ..... F17C 13/12

[52] U.S. Cl. ..... 206/0.6; 206/0.7; 220/88 R

[58] Field of Search ..... 34/15; 62/48; 206/0.7, 206/0.6; 220/3, 88 R; 148/2, 3

[56] References Cited

U.S. PATENT DOCUMENTS

| | | | |
|---|---|---|---|
| 3,338,238 | 8/1967 | Warncke | 220/3 |
| 3,356,256 | 12/1967 | Szego | 220/88 R |
| 3,868,250 | 2/1975 | Zimmermann | 148/3 |
| 4,137,102 | 1/1979 | Althoff et al. | 148/2 |
| 4,165,012 | 8/1979 | Markwood | 220/3 |
| 4,187,092 | 2/1980 | Woolly | 62/48 |
| 4,265,676 | 5/1981 | Nes et al. | 148/2 |
| 4,383,606 | 5/1983 | Hunter | 206/0.7 |

FOREIGN PATENT DOCUMENTS

| | | | |
|---|---|---|---|
| 0655380 | 1/1963 | Canada | 206/0.7 |
| 2111025 | 9/1972 | Fed. Rep. of Germany | 206/0.7 |

*Primary Examiner*—George E. Lowrance
*Assistant Examiner*—Jimmy G. Foster
*Attorney, Agent, or Firm*—Scully, Scott, Murphy & Presser

[57] ABSTRACT

A gas container, particularly a liquid gas container, for instance a propane gas container for domestic and industrial use, is provided with flame-inhibiting and explosion-retardant properties by forming the walls of the container of aluminum or an aluminum alloy and by disposing within the container a heat-conductive filler inlay formed of a three-dimensional metallic grid structure consisting of aluminum or an aluminum alloy. The filler inlay may be formed as a coil or an assembly of coils of an expanded metal.

7 Claims, 7 Drawing Figures

GAS CONTAINER

BACKGROUND OF THE INVENTION

1. Field of the Invention

The present invention relates to a gas container, and more particularly to a liquid gas container such as; for instance, a propane gas container for domestic and industrial uses.

2. Discussion of the Prior Art

Liquid gas containers, and particularly propane gas cylinders, are employed in many applications in the household, commerce and industry such as, for instance, as fuel gas supply containers. Gas containers of that type are frequently exposed to the dangers of explosion, particularly if a gas-air mixture has been formed within the container and/or upon the occurrence of sudden overheating.

SUMMARY OF THE INVENTION

Accordingly, it is an object of the present invention to provide a gas container of the type described, in which container is simple in construction, and can be economically manufactured while being assuredly protected against dangers resulting from the occurrence and propagation of flames and explosions.

In order to achieve the foregoing object, the invention contemplates the walls of the container to be formed from aluminum or an aluminum alloy, and that within the container there is disposed a heat-conductive filler inlay of a three-dimensional metallic grid structure constituted of aluminum or an aluminum alloy.

The inventive gas container according to the invention consists of aluminum or of an aluminum alloy so as to preclude the danger of the build-up of corrosion potentials between the container walls and the heat-conductive filler inlay within the container, which also consisting of aluminum or an aluminum alloy and thereby substantially eliminates the possible formation of friction and localized heat-generating spots within the container. The gas container may, for instance, be employed as a camping gas cylinder, as a fuel gas cylinder for supplying gas-fuelled household appliances, or as a liquid gas container in the automative vehicle technology. The filler inlay which is disposed within the gas container acts to rapidly conduct localized heat away from the point of its formation and to distribute it over the entire surface of the container, so as to preclude the formation of localizing overheating, as well as the generation and propagation of flames and explosions. The inventive container is adapted to be manufactured simply and economically from sheet material, tubular material, or the like. The container does not require the use of expensive anticorrosion and antifriction coatings on the container walls, particularly of the interior wall surfaces, prior to the assembly of the container. The inventive container is of very low weight, so as to facilitate its handling.

In a preferred embodiment of the inventive container, the filler inlay is formed of an expanded metal. Expanded metal is formed, in a manner known per se, from a metal sheet strip or a metal foil by cutting or punching a plurality of slits of short length therein and subsequently expanding or stretching the sheet material or foil in a direction transverse to that of the slits, to produce a grid-like structure having honeycomb-like openings surrounded by wall strips extending obliquely or vertically to the main dimension of the grid structure.

An expanded metal of this type, may, for example, be wound into a coil-shaped configuration or may be folded into the shape of a folded structure in which individual layers of the expanded metal come into contact with one another without penetrating each other. In this manner, the expanded metal may be formed into a three-dimensional grid structure in which the individual components of the grid structure have a relatively good inherent stability and stiffness, while the material of the grid structure forms only a very small fraction of the total volume of the grid structure.

In another advantageous embodiment of the inventive gas container, the filler inlay is formed of a mesh grid. Such as mesh grid may be formed from wire, and may also be coiled or folded into the shape of packages, or larger three-dimensional configurations formed from a plurality of layers. In this instance, even if the individual layers come into contact with on another, they will not penetrate each other, but will rather form a three-dimensional grid structure with the major portion of the volume incorporated therein being open space.

In a further advantageous embodiment of the gas container according to the invention, the filler inlay is formed as a coiled structure. A coiled structure of that type may be formed of an expanded metal or of a mesh grid material. Due to its cylindrical shape, a coiled structure is particularly suitable as a filler inlay for gas containers having a cylindrical interior configuration; such as for instance, for propane gas cylinders having a conventional configuration. Irrespective of whether such coiled structure has been would from an expanded or stretched metal or from a mesh grid material, it has a predetermined amount of radial compressability. The coiled structure may be wound into a size requiring it to be slightly compressed to allow for introduction into the container so as to allow it to achieve a snug fit therein. After a coiled structure of this type has been introduced into the container it will tend to expand into contact with the interior wall surface of the container so as to secure it in position. During the manufacture of the gas container, a coil of the type described may, for example, be inserted into an initially open, cup-shaped base portion of a container, with a container cap being subsequently welded to the cup-shaped base portion. The filler inlay extends substantially through the entire interior volume of a container which is produced in this manner, so that it is securely retained against displacement therein.

The inventive gas container is designed so that the filler inlay is formed of at least two coils which are adapted to be nested within each other, with the outermost coil being substantially in the form of a hollow cylinder, the outer diameter of which is dimensioned to conform with the inner diameter of the container space which is to be filled, and with the inner diameters of the coils each being adapted to conform to the respective outer diameter of the respectively adjoining inner coil. With this configuration of the filler inlay it is possible to rapidly, simple and securely produce a bottle-shaped container having a relatively narrow opening with a filler inlay extending through its entire interior space. To this effect, the outer coil is initially introduced through the opening of the container into the interior space. In order to permit the outer coil, which is in the form of a hollow cylinder, to be introduced in this manner into the container, the former may be temporarily compressed or folded inwardly, so that its outer diameter is reduced to such a degree as to enable the coil to pass through the narrow container opening. As soon as it has been introduced into the container, the outer coil will spring back into its original shape, so as to fill the radially outermost portions of the interior space of the container. An inner coil, the outer diameter of which may substantially correspond to the diameter of the opening of the bottle-shaped container, is subsequently introduced into the interior space of the container, and is simultaneously inserted into the hollow core of the outer coil. For this purpose, the inner coil may be slightly compressed in a radial direction, so as to facilitate its introduction into the hollow core of the outer coil. After insertion, the inner coil will radially expand so as to engage the innermost layer of the outer coil. If desired, one or more additional inner coils may be inserted into first inner coil and into each other. This will then result in the coils forming a unitary filler inlay structure within the container. This embodiment thus permits a filler inlay to be introduced into a bottle-shaped gas container even after the container structure itself is substantially completed. In other words, it is not necessary to initially introduce the filler inlay into the cup-shaped base portion of a container and to subsequently weld a container cap formed with the opening onto the base portion.

In another advantageous embodiment of the gas container according to the invention, the filler inlay may be formed as a folded structure. The formation of a filler inlay by folding a plurality of layers of a strip-shaped expanded metal or a strip-shaped meshed grid material over each other results in a substantially rectangular three-dimensional grid structure. A structure of this type is particularly adapted to be employed as a filler inlay for a container have a substantially cubic or rectangular interior space.

The inventive gas container may be advantageously designed in a manner such that the filler inlay is disposed within the container to be secured therein against any relative displacement. An arrangement of this type results if the filler inlay is formed as a coil structure dimensioned so as to conform to the interior diameter of the container. However, it is also possible to introduce a filler inlay into an initially open portion of the container, and to secure it therein against relative displacement such as spot-welding it to the container wall or by positive engagement thereof with projections which are provided on the interior wall surface of the container. These and similar provisions assuredly preclude the danger of the filler inlay scraping against the interior wall surfaces of the container in the case of intensive movements of the latter and thus eliminate the generation of friction and heat.

In a particularly advantageous embodiment of the gas container, the expanded metal is formed by punching and expanding or or stretching a foil of aluminum or an aluminum alloy having a thickness within the range of about 0.02 mm to 0.1 mm, and preferably of 0.085 mm. An expanded aluminum or an aluminum alloy foil having a thickness within the above-specified range is of a particularly low weight and ensures the formation of an advantageous honeycomb structure by the individual openings of the expanded metal in combination with an adequate inherent stiffness, as well as a predetermined inherent resiliency of a coil or a multiple-layer structure formed therefrom. A three-dimensional grid structure formed of an expanded metal foil of this type occupies no more than about 2 to 4% of the total volume enclosed by the grid structure. A filler inlay of this type thus entails only an insignificant reduction in the useful volume of the gas container.

In a further advantageous embodiment of the inventive gas container, the aluminum alloy employed for the filler inlay is AlMgSil. This aluminum alloy has been found to be particularly suitable as the material for a heat-conducting and, as a result, explosion-inhibiting grid structure in the gas container.

According to a further advantageous aspect of the invention, the aluminum alloy employed for the container itself is AlMgSil.

BRIEF DESCRIPTION OF THE DRAWINGS

Reference may now be had to the following detailed description of preferred embodiments of the invention in the form of propane gas cylinders and of a fuel gas tank for a vehicle, in conjunction with the accompanying drawings; in which.

DETAILED DESCRIPTION

Figure 1:
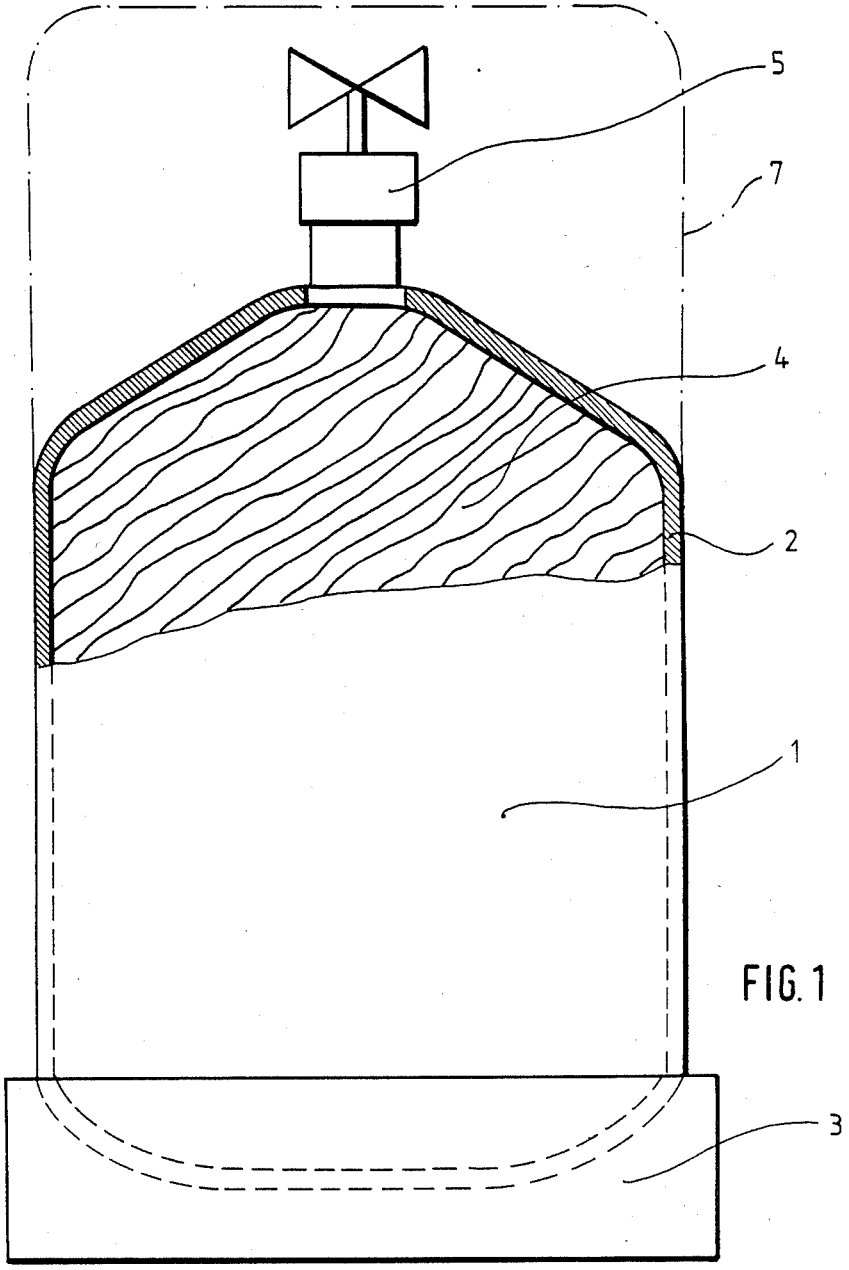
FIG. 1 shows a partially sectioned and partially diagrammatical side elevational view of a propane gas cylinder according to one embodiment of the invention.

In FIG. 1 there is shown a gas container, according to one embodiment of the invention, in the form of a propane gas cylinder. The container 1 itself is constructed by welding a cover portion having a circular cross-section onto a cup-shaped base portion of cylindrical shape. The walls 2 of container 1 consist of the aluminum alloy AlMgSil. Attached to the lower end of container 1 is an annular base portion 3 which is constituted of the same material. The interior of container 1 contains a heat-conductive filler inlay 4 formed of a three-dimensional metallic grid structure, similarly formed of the aluminum alloy AlMgSil in the illustrated example. In FIG. 1, the three-dimensional grid structure is indicated by a plurality of obliquely extending lines. The grid structure substantially fills the interior of container 1 so as to be securely retained against any axial and radial displacement relative to the container. Any relative frictional movement between the container and the filler inlay is thus precluded.

Figure 2:
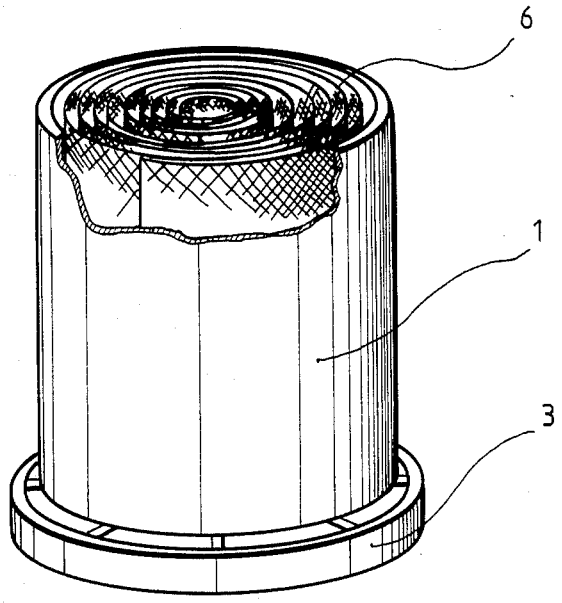
FIG. 2 shows a partly sectional perspective view of the propane gas cylinder in FIG. 1.
Figure 3:
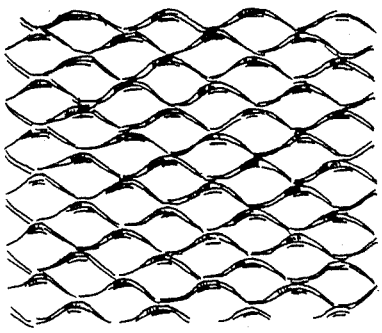
FIG. 3 shows an elevational view of a portion of an expanded metal material used for a filler inlay for the propane gas cylinder of FIGS. 1 and 2.

From FIG. 2 it is apparent that the filler inlay of the illustrated embodiment is formed as an expanded metal coil. FIG. 3 shows a portion of an AlMgSil expanded metal formed by punching and expanding a foil section which has a thickness of 0.085 mm. The individual honeycomb-shaped openings of the expanded metal are clearly shown in FIG. 3. A cylindric filler inlay for substantially filling the cylindrical interior space of the propane gas cylinder according to FIGS. 1 and 2, is formed by winding the expanded metal into a coil 6, the outer diameter of which is dimensioned such that the coil 6 has to be slightly compressed to allow for insertion into the initially open cup-shaped base portion of the gas container. After insertion into the base portion, the coil 6 resiliently expands into its previous shape so as to come into engagement with the interior wall surface of the container. The height of coil 6 is preferably selected such that the coil substantially fills the the interior space of the container in also the axial direction thereof. In this manner, coil 6 is retained in its position relative to the container, so that it is inhibited from any movements. The coil 6 of expanded metal forms a three-dimensional grid structure occupying only about 2 to 4% of the volume it subtends. After coil 6 has been inserted into the base portion of the propane gas cylinder, the cover is positioned on the base portion and sealingly affixed thereto by a circumferentially extending weld seam. The soundness of the gas-tight connection may be verified in a known manner, such as by means of X-ray examination or through an endoscope. The use of an endoscope additionally permits an examination of the grid structure disposed in the interior space of the gas container. Mounted on the top portion of the gas container is a suitable connector and valve assembly 5.

As in the illustrated propane gas cylinder, both the expanded metal filler inlay and the container itself are constituted of the aluminum alloy AlMgSil, so as to preclude any corrosion potentials between these parts, as well as the occurrence of frictional wear. Any localized overheating which would otherwise be caused by these phenomena is thus precluded. Also obviated is the danger of any leaks of the propane gas cylinder due to corrosion. The filler inlay acts as a heat-conducting and heat-dispersing three-dimensional grid structure, and acts to render any localized heat generation harmless by distributing the developed heat over the entire extent of the filler inlay. In this manner the filler inlay acts as a safety grid structure which will retard or inhibit the development of flames and explosions.

The propane gas cylinder according to FIGS. 1 to 3 is of a very light weight so that it is easily handled, and thereby lends itself to a simple and economical manufacture. Due to its exceptional flame-retardant properties and protection against explosion, there is eliminated any need for overpressure safety devices and further valves in addition to the connector-valve assembly.

The upper portion of the propane gas cylinder is protected by a removable cover 7 is indicated in FIG. 1 through chain-dotted lines.

Figure 4:
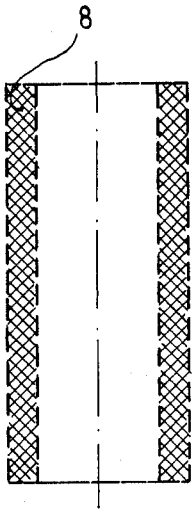
FIG. 4 shows a diagrammatic axial sectional view through an outer hollow-cylindrical coil of a filler inlay formed of two nested coils for the propane gas cylinder of FIG. 1.
Figure 5:
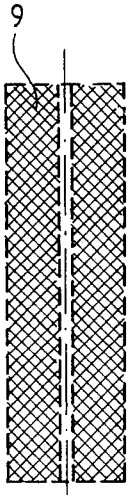
FIG. 5 shows a diagrammatical axial sectional view through an inner coil of the filler inlay of FIG. 4 for a propane gas cylinder.
Figure 6:
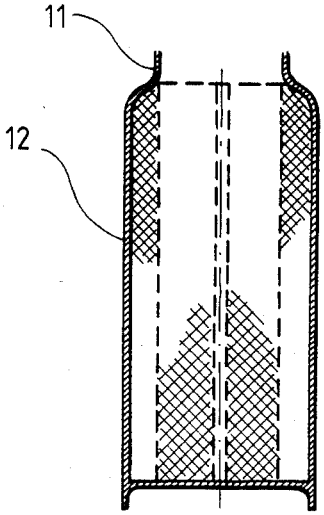
FIG. 6 shows a diagrammatical axial sectional view through a propane gas cylinder containing a filler inlay formed of two nested coils as shown in FIGS. 4 and 5.

Shown in FIGS. 4 to 6 is an embodiment of the inventive gas container in the form of a propane gas cylinder. In this embodiment, the filler inlay is formed of two expanded metal coil structures nested one within the other. The material of the two coil structures is preferably the same as the material specified for the embodiment of FIGS. 1 to 3. The outer coil 8 (FIG. 4) and the inner coil 9 (FIG. 5) are each prepared separately. The outer diameter of the outer coil is dimensioned so as to substantially conform to the inner diameter of the container which is to be filled with the filler inlay, so that its resilient expansion after insertion into the container causes the outer coil to snugly engage the inner wall surface of the container. Due to the relatively thin "wall thickness" of the hollow-cylindrical outer coil, the latter can be inserted into the container even through relatively narrow openings, such as the opening 11 of the cylinder 12 shown in FIG. 6. In this connection, the cylindrical coil may be resiliently deformed and have its diameter reduced by folding its wall inwardly so that it is able to be inserted through the opening 11 into the cylinder 12. As soon as the outer coil 8 has been so inserted into the cylinder 12, its inherent resiliency causes it to assume its original cylindrical shape and to expand into engagement with the inner wall surface of the cylinder 12, subsequent to which the inner coil 9 (FIG. 5) may be introduced into the cylinder 12 through opening 11. The outer diameter of inner coil 9 is selected so as to substantially conform with the inner diameter of outer coil 8. Resilient compression of the inner coil permits the outer diameter thereof to be temporarily reduced to such a degree, that the inner coil 9 can pass through the opening 11 of the cylinder 12 for its insertion into the hollow core of outer coil 8. As soon as the inner coil has been fully inserted into the cylinder 12, its inherent resiliency causes it to expand so as to engage the inner periphery of the outer coil 8 and to form therewith a filler inlay; effectively acting therewith as a unitary structure. The center of inner coil 9 may be formed with a hollow core 13 having a small diameter. This hollow core may be used for introducing therein to a test probe or a dip tube. This embodiment permits the interior space of bottle-shaped containers to be substantially completely filled with the filler inlay. The filler inlay can be inserted into the finished bottle-shaped container in a simple manner. It is thus not necessary to initially insert the filler inlay into a cup-shaped base portion of the container and to subsequently finish the assembly of the container by welding a cover portion thereto. Since both the two coils 8 and 9 and the walls of the cylinder 12 itself are constituted of the same aluminum alloy AlMgSil, the development or corrocion potentials between the two coils of the filler inlay, as well as between the filler inlay and the container, is successfully obviated. Both coils 8 and 9 are formed of expanded metal made of an AlMgSil foil, each having a thickness of 0.085 mm.

Figure 7:
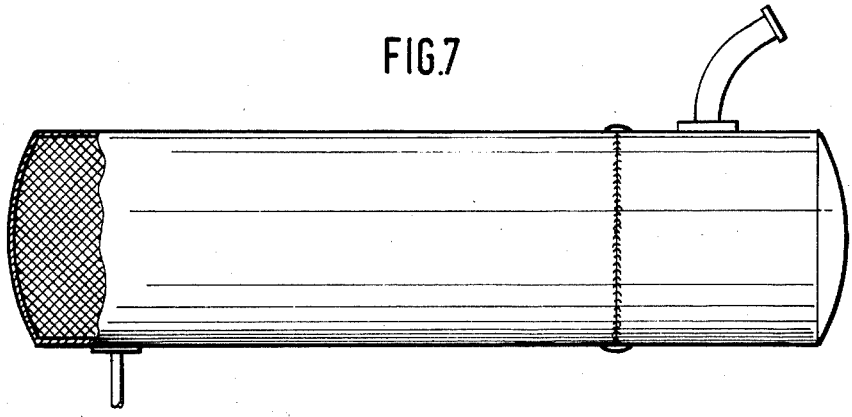
FIG. 7 shows a diagrammatical side elevational view of a fuel gas tank for a vehicle pursuant to a further embodiment of the invention.

FIG. 7 shows a container according to the invention in the form of a fuel gas tank for motor vehicles. The container shown in FIG. 7 is of a substantially cylindrical shape. The filler inlay of this container may consist of an expanded metal coil. The container itself may be formed of two cup-shaped portions welded to each other. In this case, the expanded metal coil, the diameter of which is dimensioned so as to permit the coil to be inserted into the container in a slightly compressed condition, is initially inserted into one of the two cup-shaped portions of the container.

The other cup-shaped portion of the container is subsequently pushed over the freely projecting end of the coil until it comes into engagement with the first cup-shaped portion, whereupon the two cup-shaped portions are welded to each other along the circumference of their abutting ends. Hereby, the cylindrical container is completely filled with the expanded metal coil forming the filler inlay. The material employed both for the filler inlay and for the walls of the container, preferably, is again the aluminum alloy AlMgSil. The filler inlay coil may be formed of expanded metal from a foil having a thickness of 0.085 mm. The length and diameter of the cylindrical fuel gas tank are dictated by the required capacity of the tank. The length of the tank, for instance, may be about 1,200 mm, and with an outer diameter of, for instance, 200 to 300 mm.

The scope of the invention is not limited to the embodiments shown and described. Gas containers according to the invention can be of different shapes and possess a wide range of capacities, and may be employed for selectively storing various kinds of gases, liquid gas, or combustible liquids. Besides the storage of propane, the storage of, for example, butane or methane can also be considered in the inventive containers.

I claim:

1. A cylindrical container for liquid gas comprising walls including a main cylindrical wall portion, wherein said walls enclose said container and are formed of an aluminum alloy and a heat-conductive filler inlay arranged within said cylindrical container, said heat-conductive filler inlay being formed of a three-dimensional metallic grid structure of a cylindrical shape formed of at least two coils of expanded metal nested within each other, wherein said expanded metal is made of an aluminum foil having a thickness within the range of about 0.02 mm to 0.1 mm.

2. The container as claimed in claim 1, wherein an outermost coil substantially in the shape of a hollow cylinder having an outer diameter dimensional to conform with the interior diameter of the container, the inner diameter of said coils each being adapted to conform with the respective outer diameter of an adjoining inner coil.

3. The container as claimed in claim 1, wherein said filler inlay is arranged within said container secured against relative movement therewith.

4. The gas container as claimed in claim 1, wherein said expanded metal is formed by punching and expanding a foil of aluminum or an aluminum alloy having a preferred thickness of 0.085 mm.

5. The container as claimed in claim 1, wherein the aluminum alloy for said filler inlay is AlMgSil.

6. The container as claimed in claim 1, wherein the aluminum alloy for said container is AlMgSil.

7. The container as claimed in claim 2, wherein the outermost coil and the inner coils are constituted of the same material.

* * * * *